United States Patent [19]

Lowther

[11] Patent Number: 4,873,928

[45] Date of Patent: Oct. 17, 1989

[54] NUCLEAR-SIZED EXPLOSIONS WITHOUT RADIATION

[75] Inventor: Frank E. Lowther, Plano, Tex.

[73] Assignee: APTI, Inc., Los Angeles, Calif.

[21] Appl. No.: 62,020

[22] Filed: Jun. 15, 1987

[51] Int. Cl.[4] ..... F42B 3/00

[52] U.S. Cl. ..... 102/323; 102/324; 149/109.2; 434/218

[58] Field of Search ..... 149/109.6, 109.1, 109.2; 102/323, 324; 434/218

[56] References Cited

U.S. PATENT DOCUMENTS

| | | | |
|---|---|---|---|
| 2,811,431 | 10/1957 | Zwicky et al. | 149/1 |
| 2,886,424 | 5/1959 | Hyslop, Jr. | 149/1 |
| 3,188,253 | 6/1965 | Patrick | 149/1 |
| 3,222,230 | 12/1965 | Hebenstreit et al. | 149/1 |
| 3,259,532 | 7/1966 | Reynolds et al. | 149/1 |
| 3,670,494 | 6/1972 | Papp | 60/23 |
| 3,680,431 | 8/1972 | Papp | 176/1 X |
| 4,291,623 | 9/1981 | Robinson et al. | 102/310 |
| 4,393,509 | 7/1983 | Merkel et al. | 376/156 |

OTHER PUBLICATIONS

Austin et al., *Explosive Hazard of Aluminum–Liquid Oxygen Mixtures,* Jour. Chem. Ed., vol. 36, #2, Feb. 1959, pp. 54–57.

*Primary Examiner*—Peter A. Nelson
*Attorney, Agent, or Firm*—Drude Faulconer

[57] ABSTRACT

A method for producing a high yield explosion without radioactive fallout comprising filling an expendible structure with an explosive mixture of a combustible gas (e.g. methane) and an oxidizer gas (e.g. oxygen) and then detonating said mixture.

15 Claims, 5 Drawing Sheets

NUCLEAR-SIZED EXPLOSIONS WITHOUT RADIATION

DESCRIPTION

1. Technical Field

The present invention relates to a method for producing explosions from an explosive gas mixture which has a shock yield comparable to a nuclear explosion but one which produces no radioactive fallout.

2. Background Art

Between 1945 and 1960, the United States exploded nuclear devices which had a total yield equivalent to approximately 200 megatons (MT) of trinitrotoluene (T.N.T.). Tests conducted by other countries during this time brought the total yield of nuclear explosions to approximately 400 MT. It was quickly recognized that such testing could not continue since each nuclear explosion produced radioactivity that seriously threatened the environment. To protect the environment from such radioactive fallout, most of the world's nuclear powers signed the Nuclear Test Ban Treaty in 1963 which prohibited nuclear explosions in the atmosphere, underwater, and in space. Since that time, it is believed that substantially all nuclear explosions have been carried out underground.

The necessary prohibition against above-ground testing of nuclear explosives, however, has created situations where alternates to such explosions are needed. For example, all of the sophisticated communication systems, defense systems, weapon systems, etc. that have been designed and built for the military since 1963 have never been tested in their ultimate operating environments, i.e. under nuclear blast conditions. Obviously, any such testing has to be simulated through theoretical studies and/or under laboratory conditions. Radiation dosages and electromagnetic pulses which simulate those from nuclear explosions have been produced in shielded laboratories but the extreme shock energies which can be expected from nuclear explosions, e.g. 1 kiloton (KT) or larger, have not been satisfactorily duplicated. Without realistic testing, the question will always remain as to whether or not a particular system or component will survive a nuclear explosion. To provide such realistic testing with conventional explosions is impractical as will become obvious from the following discussion.

The conventional explosive, T.N.T., is the recognized standard of measurement and comparison for both nuclear and non-nuclear explosions. That is, the exploding of a kiloton (KT) or 2,000,000 pounds of T.N.T. releases $4.1\times10^9$ Btus. It follows that the exploding of any material that release $4.1\times10^9$ Btus is referred to as a 1 KT explosion. To amass 1 KT of T.N.T. at a single test site, in itself, is an ambitious and dangerous undertaking. For example, it is esimtated that it would take a 20-boxcar train to transport this amount of T.N.T. and the risks involved with such a shipment from a manufacturing or storage facility to the test site are self evident.

Further, when detonated, one volume of T.N.T. suddenly converts to 1000 volumes of gas. The speed and uniformity of "burn" and therefore the violence of T.N.T. depends upon the uniformity of the ignition method. Normal sized T.N.T. charges explode in microseconds but massive T.N.T. charges may take much longer due to the practical problems involved in uniform ignition. The transportation and the uniform detonation problems of large masses of T.N.T. makes its use as a source for simulated, nuclear-sized explosions both unattractive and impractical.

Accordingly, to produce a practical, non-nuclear explosion having nuclear-sized shock yields, the following criteria would seem imperative. First, there must be a reliable source of an explosive which is readily available in adequate quantities to support a continuing test program. Next, the explosive must be capable of being safely and reliably transported from its source to a remote test site. Further, a relatively inexpensive, expendible, test structure must be provided in which the explosive can be loosely contained until detonated. Lastly, the explosive must be capable of relatively instant and uniform detonation so that the violence of the blast adequately simulates that of a nuclear explosion.

DISCLOSURE OF THE INVENTION

The present invention provides a method for producing an explosion which yields shock energies equivalent to nuclear explosions but one which generates no radioactive fallout. Basically, the present invention utilizes a commonly available combustible gas, e.g. natural gas, methane, etc., mixed with a commonly-available oxidizer gas, e.g. oxygen, air, etc., as the explosive mixture for a large scale explosion. Methane, e.g. natural gas, is readily available in large quantities which can quickly and easily be transported to a remote test site by a common pipeline or the like.

More specifically, the present invention provides a method for producing an explosion by filling a large, expendible structure, e.g. an inflatable envelope, at a test site with an explosive mixture of methane and oxygen and then detonating said mixture. To provide a relatively safe operating environment during the filling operation, the envelope is first partially filled with an initial filling mixture comprised of methane and oxygen wherein the concentration of methane is too rich for the mixture to either burn or explode. After the initial filling mixture is in place, the mixture is "armed" or "topped-off" with additional oxidizer gas, e.g. oxygen, either in gas or liquid form, to change the relative concentration of methane and oxygen to one which will readily explode when detonated.

A plurality of detonation means can be used to effect a relatively unfiorm detonation front across the mixture within the envelope. Such means include conventional explosives, exploding bridge wires, dipole antennae activated by radio frequencies, metallic or organic dust particles, and/or metallic filaments dispersed throughout the explosive mixture.

BRIEF DESCRIPTION OF THE DRAWINGS

The actual construction, operation, and the apparent advantage of the invention will be better understood by referring to the drawings in which like numerals identify like parts and in which.

BEST MODE FOR CARRYING OUT THE INVENTION

Figure 1:
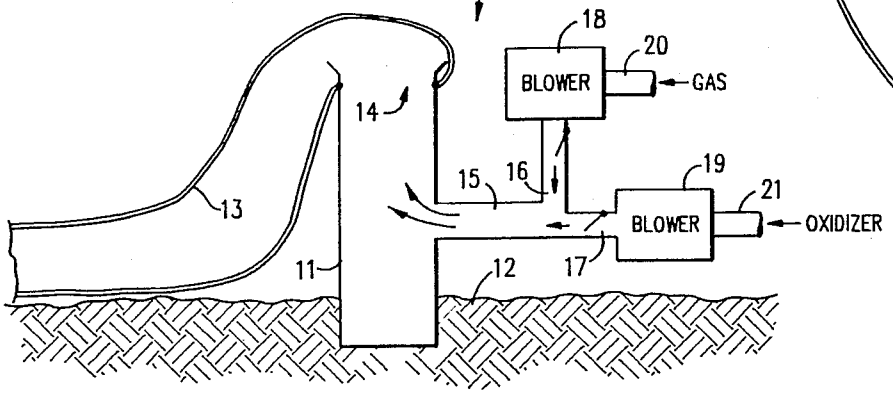
FIG. 1 is a schematical section of a test site having apparatus for inflating an envelope with a combustible gas-oxidizer gas mixture.

Referring more particularly to the drawings, FIG. 1 discloses a test stand 10 comprised of base conduit 11 which is anchored into the ground 12 by any suitable means. A gas-tight, expendible, test structure, e.g. flexible envelope 13, has a filling inlet 14 which is secured in a fluid-tight relationship over the upper end of conduit 11. Conduit 11 has a manifold 15 connected thereto which, in turn, has two inlets 16, 17. Inlet 16 is connected to a combustible gas blower 18 while inlet 17 is connected to an oxidizer gas blower 17.

Preferably, the combustible gas is one that is naturally-available in large quantities and is one that can easily and safely be transported to the test site. For example, large quantities of natural gas, i.e. methane, are readily available in several geographical areas. Especially attractive are the huge quantities of methane in the North Slope Area of Alaska since there are remote areas nearby which are suitable as a test site. The methane can be produced and safely transported to the test site by a common pipeline. However, the test site does not have to be in close proximity to the methane production area since the methane can be gathered and safely pipelined for long distances as is now commonly done in supplying energy to areas remote from the production area. In the following descriptions, methane will be used in interchangeable with combustible gas and oxygen with oxidizer gas but, it should be understood, that obvious equivalents of these gases are intended to be covered hereunder.

A methane-ozygen mixture will neither burn nor explode if the methane concentration ($CH_4$) is less than 5.4% or greater than 59.2% by volume. Accordingly, blower 18 feeds methane from pipeline 29 and blower 19 feeds oxygen from line 21 into manifold 15 at rates whereby the resulting mixture in manifold 15 is comprised of approximately 59.2% methane and 40.8% oxygen by volume. This initial filling mixture, which will neither burn nor explode, then flows into envelope 13 to fill the envelope to approximately 85% of its total capacity. By using a nonexplosive gas mixture to initially fill the envelope to near its capacity, the test system remains "unarmed" and the risk of a disastrous accident during filling is minimized. Also, the partially-filled envelope can be left in this condition for extended periods with little risk.

Just before a test explosion is to be carried out, the methane-oxygen mixture in envelope 13 is armed or "topped-off" by flowing only oxygen through manifold 15 until envelope 13 is filled to capacity. At this time, the mixture in envelope 13 will be comprised of approximately 50% methane and 50% oxygen, which is a highly explosive mixture. A detonation means within envelope 13 (not shown in FIG. 1) is actuated and a violent explosion results. The means for detonating the gas mixture may any one of the several means which are described in detail below.

To more fully understand the present invention, a specific example for producing a nonnuclear explosion having a shock yield equivalent to 1 KT of T.N.T. will now be set forth. A base conduit 11 having a diameter of 9.5 feet is securely anchored in ground 12. A 110-horsepower (h.p.) blower 18 supplies methane through inlet 16 (7.3 feet diameter) into manifold 15 at a rate of approximately 2100 cubic feet per second (CF/sec) while a 75-h.p. blower 19 supplies oxygen through inlet 17 (6 feet diameter) into manifold 15 at a rate of approximately 1420 CF/sec.

To assure proper gas mixing and agitation, the mixture (59.2% methane-40.8% oxygen by volume or $CH_4 + 0.689\ O_2$) flows into envelope 13 as an initial filling mixture at a linear velocity of 50 feet/sec. Inflatable envelope 13 is comprised of DuPont 6/6 reinforced Nylon having a thickness of 2.42 mils. The reinforced Nylon will not rupture if punctured, as a rubber ballon would, but instead will only allow the gas to leak slowly through the puncture itself. When completely inflated, envelope 13 is spherical with a diameter of 305 feet and a total capacity of $14.9 \times 10^6$ CF. When empty, envelope 13 will weigh approximately 1.29 tons. It will take approximately one hour at the above rates to fill envelope to approximately 85% of its total capacity with the non-explosive mixture. At this point, envelope 13 contains 12.6 million cubic feet (MMCF) of gas mixture of which approximately 7.5 MMCF is methane and 5.1 MMCF is oxygen.

Preferably, a short time before the test is to be conducted, the mixture is envelope 13 is "armed" or topped-off with additional oxidizer gas, oxygen, to provide a highly explosive mixture of approximately 50% methane-50% oxygen. To accomplish this, approximately an additional 2.32 MMCF of oxygen is supplied through manifold 15 by blower 19 at approximately 1420 CF/sec. In approximately 27 minutes, envelope 13 will be fully inflated with the explosive methane-oxygen mixture and will have an internal pressure of approximately 0.1 psi above the ambient pressure. The mixture is then detonated by any of the means described below.

It is estimated that when a 50% methane-50% oxygen mixture explodes, 1 MMCF of mixture yields energy equivalent to 0.0671 KT of T.N.T. Accordingly, the $14.9 \times 10^6$CF volume within envelope 13 will yield energy equivalent to 1 KT of T.N.T.

The speed and uniformity of "burn" and therefore the violence of any explosion depends upon the uniformity of the detonation method used in initiating the explosion. If all of the available chemical energy is to be released in an explosion, the combustion front must propagate across the entire combustible gas volume without being extinguished. It is the chemical heat release in the combustion front that generates and supports a faster shock front. If the combustion front is stopped or interrupted for any reason, the explosion will stop or will be interrupted.

Figure 2:
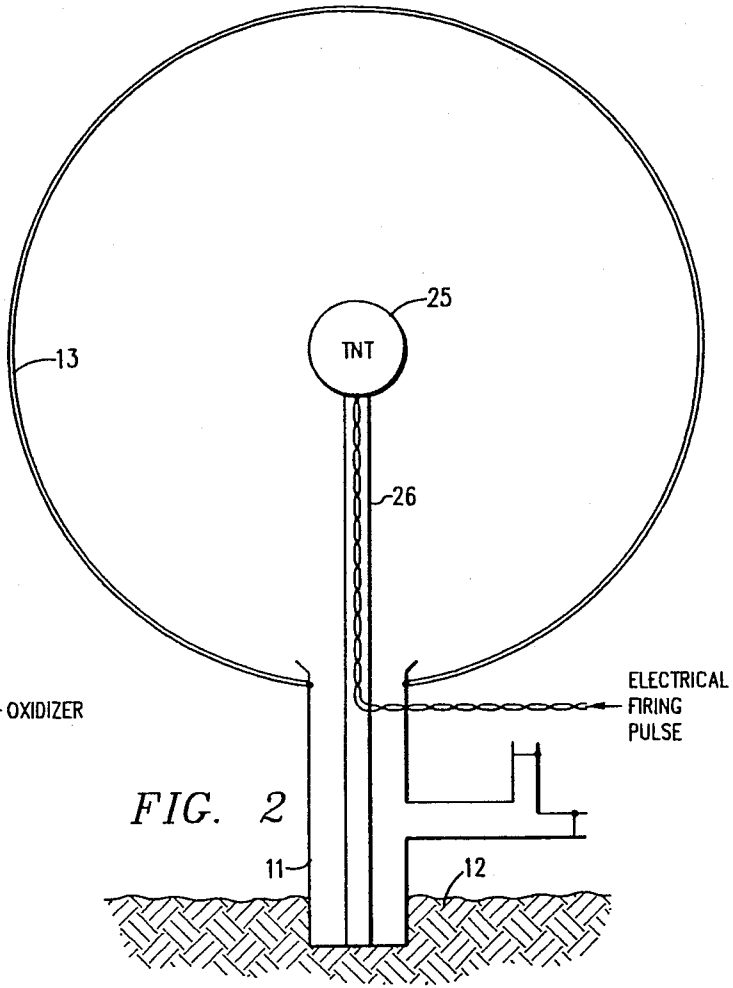
FIGS. 2–9 are schematical sections of a variety of different means for detonating an explosive gas mixture within the envelope of FIG. 1.

Turning now to FIGS. 2–8, various means for detonating the explosive mixture in envelope 13 are disclosed. In FIG. 2, a charge 25 of a conventional explosive such as T.N.T. is positioned at the approximate center of envelope 13 on a support 26 and is sized to provide rapid detonation of the volume of gas in envelope 13. Charge 25 may be prepositioned within the envelope before inflation begins. Charge 25 is denotated in a conventional manner by an electrical firing pulse through line 26.

Figure 3:
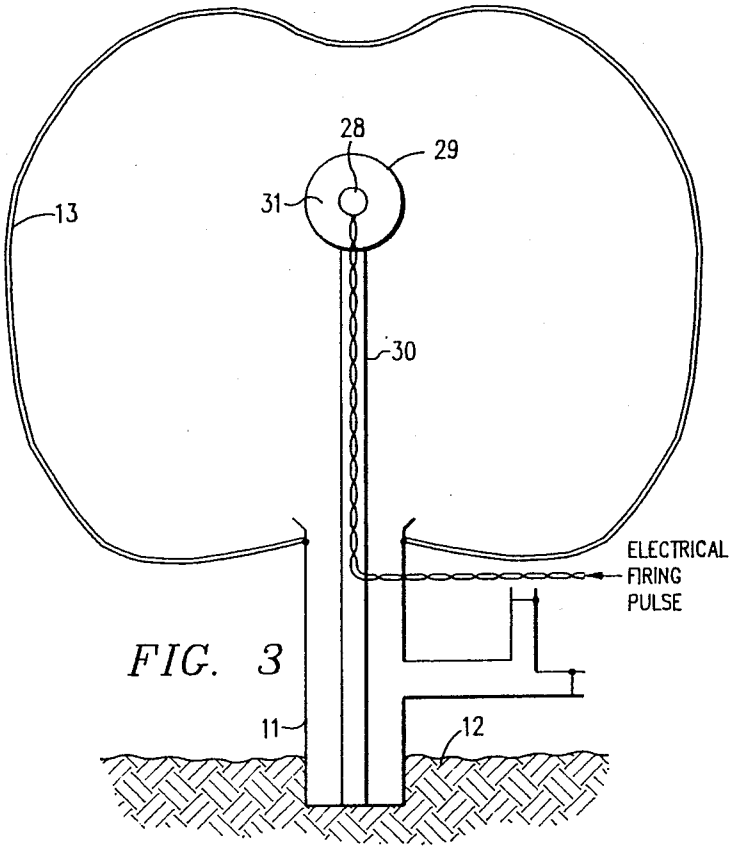

FIG. 3 illustrates a modification of the present invention wherein the test system is both armed (i.e. topped-off with oxygen) and denotated substantially simultaneous. Envelope 13 is partially inflated with a non-explosive, methane-oxygen mixture in the same manner as described above. A charge 28 of conventional explosive, e.g. T.N.T., is positioned within container 29 which is positioned at the center of envelope 13 on support 30 and which is filled with additional oxidizer gas. The additional oxidizer gas is preferably in concentrated form, e.g. compressed oxygen gas on liquid oxygen (LOX) 31. If LOX is used, charge 28 is sized so that when detonated by an electric pulse through line 32, the LOX will be vaporized to provide and dispurse the "arming" oxygen throughout the mixture in envelope 13. For the specific example described above, a charge 28 of 9500 pounds of T.N.T. in a spherical shape having a diameter of 5.7 feet is positioned within container 29 having a diameter of 17.9 feet which, in turn, is filled with 103.5 tons of LOX. These amounts are calculated knowing the heat of vaporization of LOX to be 92 Btus/pound and that the exploding T.N.T. will provide 2000 Btus/pound.

Figure 4:
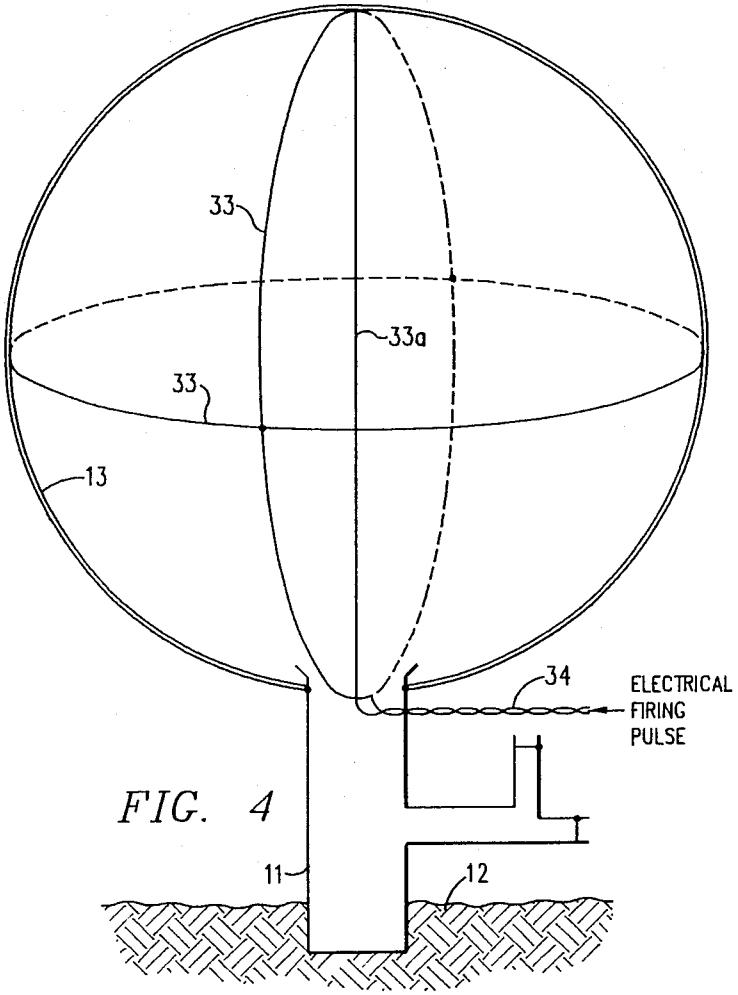

FIG. 4 discloses another detonation means for initiating the explosion of the methane-oxygen mixture in envelope 13. Lengths of detonating cord 33, e.g. Ensign-Bickford "Primacord" by DuPont, is secured to the inner surface of envelope 13 along various circumferences (only two shown). The cords 33 are secured in position before inflation and additional lengths 33*a* (only one shown) can be suspended from the inside of the top of envelope so that they will hand downward through the mixture when envelope 13 is inflated. Detonating cord is a flexible cord that contains a center core of a conventional explosive, e.g. pentaerythritol tetranitrate (PETN), which denotates at a velocity of 22,000 feet per second and may contain up to 400 grains of explosive per foot, enough to trigger an explosion. Cords 33, 33*a* are denotated by a conventional detonator, e.g. blasting caps, which is actuated by an electrical pulse through line 34.

Figure 5:
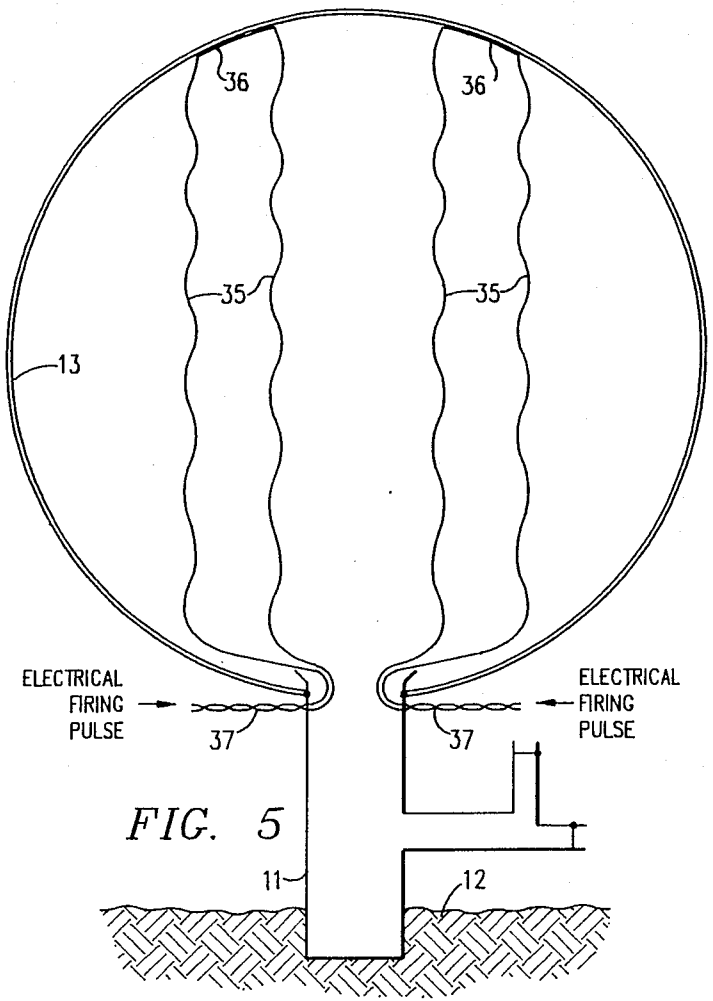

FIG. 5 discloses still another means for detonating the mixture in envelope 13. A plurality of bridge wires 35 (only two shown) are looped within envelope 13 and attached at the inside of the upper surface thereof before inflation so that they will extend across the envelope when it is inflated. Investigations into the use of exploding bridge wires have revealed some very unique features thereof such as the capability of (1) injecting energies in the 10 kilocalories and greater per mole range in submicrosecond time intervals and (2) producing high energy which, in turn, imparts high velocity to the physical mass of the reactants in contact with the wire. Accordingly, an exploding wire provides a way of concentrating large amounts of energy in a small space. Typically, a bank of capacitors (not shown) are charged to a high voltage level. The capacitors are then discharged through lines 37 into wires 35. The current through the wires is many magnitudes greater than that necessary to fuse the wire. The extreme resistive heating in the wire causes a mean instantaneous vaporization of the wire which creates a shock wave in the atmosphere surrounding the wire to thereby initiate an explosion of the mixture in envelope 13.

Figure 6:
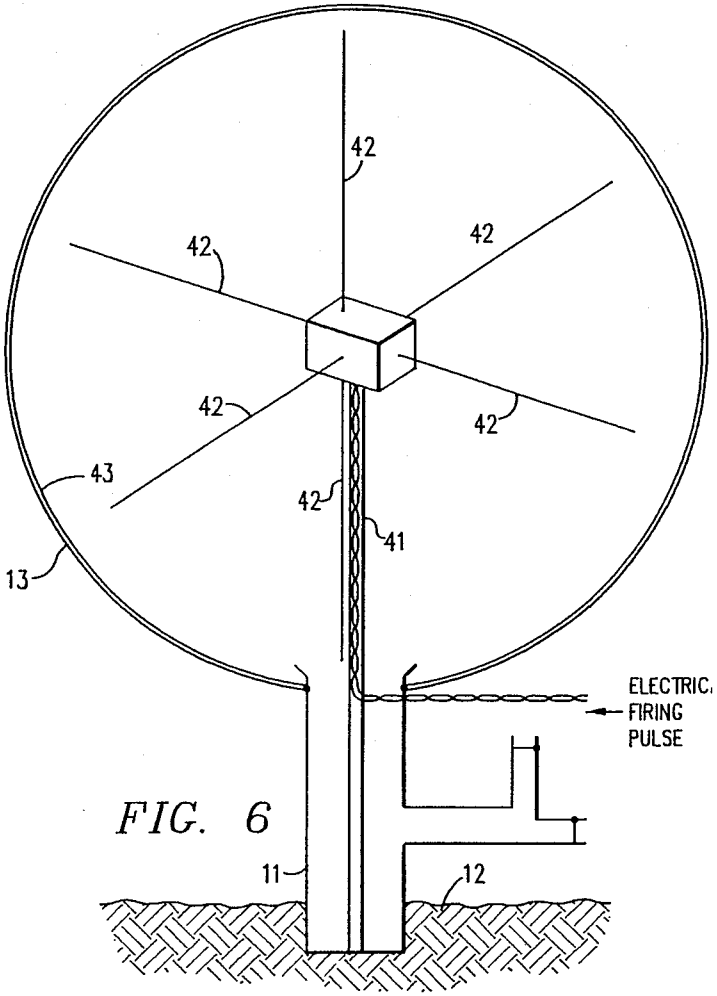

FIG. 6 discloses a still further means for detonating the explosive mixture in envelope 13. A one-shot, radio frequency transmitter 40 is positioned at the center of envelope 13 on support 41. A plurality of center-fed, dipole antennae 42 extend outward to the inner surface of enelope 13 which may be coated with a thin metallic layer 43, e.g. aluminum. A single extremely high energy radio-frequency pulse is delivered to transmitter 40 through line 43 which, in turn, transmits the energy through dipole antennae 42. Since the energy is several orders of magnitude higher than antennae 42 are designed to handle, antennae 42 and metallic layer 43 will vaporize, basically in the same manner as an exploding bridge wire as described above.

Figure 7:
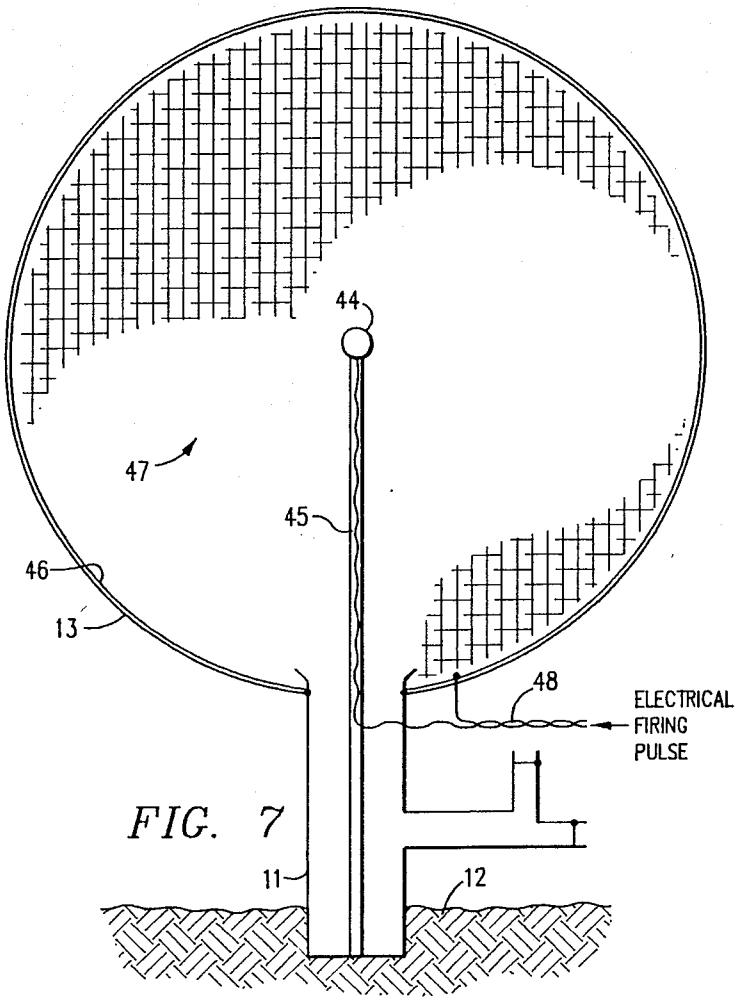

FIG. 7 discloses another means for detonating the explosive mixture in envelope 13. A center electrode 44 is positioned at the center of envelope 13 on support 45 and the inner surface of envelope 13 is coated with a thin metallic layer 46, e.g. zirconium, to act as a second electrode. A mesh of thin wire-like, filaments of metal, e.g. zirconium, is positioned within and throughout envelope 13 to create what is, in effect, a giant "flash bulb". A high energy, electrical pulse is supplied through lead 48 to ignite the metalic mesh 47 throughout envelope 13 to thereby initiate the explosion.

Figure 8:
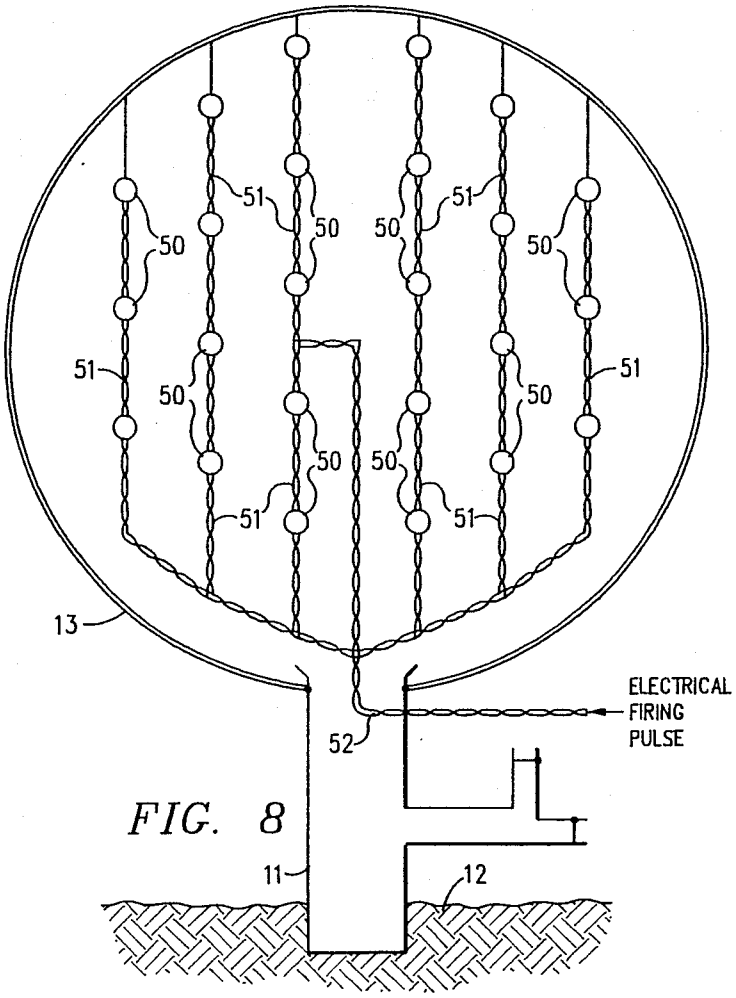

FIG. 8 discloses still another means for detonating the mixture in envelope 13. A plurality of electric blasting caps 50 are spaced on stringers 51 which are suspended within envelope 13 and are all connected to a firing lead 52. Caps 50 are fast-functioning, high strength instantaneous caps that detonate in less than half a millisecond after sufficient current flows through a bridge wire in each cap, e.g. DuPont "SSS" seismograph jet tapper electric blasting caps. Energy through firing lead 52 is delivered to each cap 50 at the same time so that all caps 50 detonate simultaneously to generate the maximum explosion within envelope 13.

Figure 9:
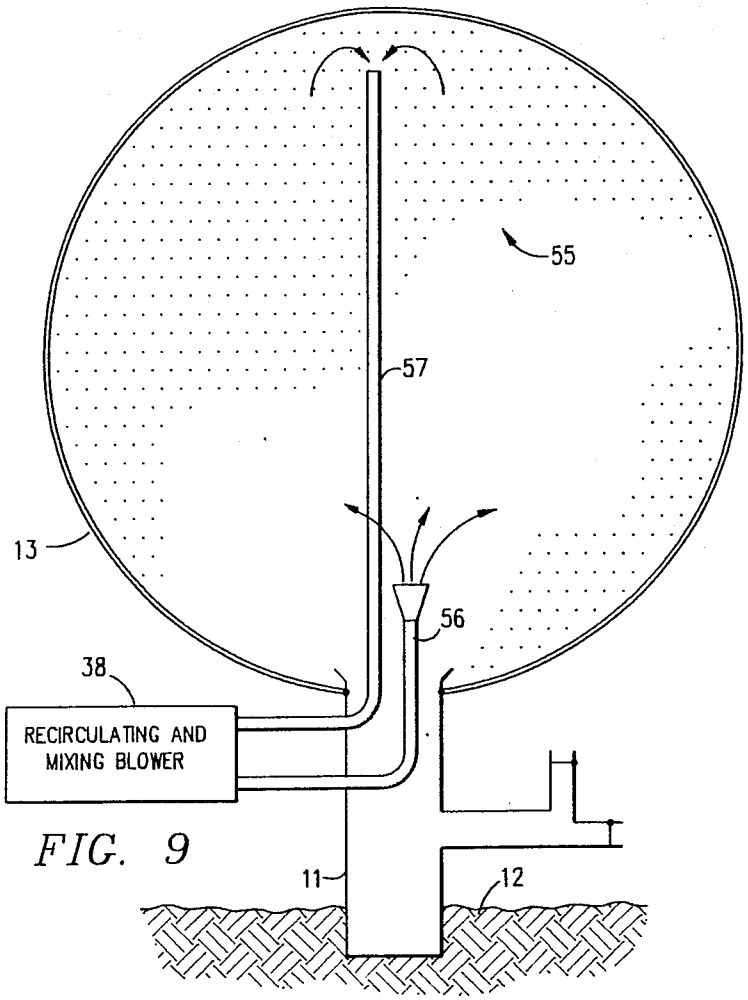

FIG. 9 discloses still another means for detonating the mixture in envelope 13 which can be used in combination with any of the detonation means disclosed above. Metallic dust, flakes, small bits of wire, or the like 55, e.g. aluminum or organic dust, e.g. grain dust, is sprayed or otherwised distributed into the methane-oxygen mixture in envelope 13. One way of distributing this material is shown in FIG. 9 wherein the dust particles are sprayed out under pressure through inlet conduit 56. Outlet conduit 57, continuously sucks a portion of the dust and mixture from envelope 13 and circulates some through mixing blower 58 and back into envelope 13 through inlet conduit 56. For the above example, it is estimated that a 200-h.p. blower 58 will completely recirculate the contents of envelope 13 every hour.

Aluminum dust concentrations as low 0.025 ounce per cubic foot in air are known to explode violently. The dust may be ignited by a modest radio signal. If the aluminum dust is ignited by a remote radar signal, it would take the radar energy 0.3 microseconds to travel the diamter of a 268 foot sphere. It is estimated that the methane-oxygen detonation wave travels 6000 feet per second so where the aluminum dust particles are separate by 254 microns, the explosion within envelope 13 will take about 0.2 microseconds after the aluminum is ignited. This results in the entire methane-oxygen explosion taking place in less than one microsecond, making it as fast or faster than an equivalent T.N.T. explosion or nulcear explosion.

As stated above, dust particles can be dispersed into the envelope 13 and used in conjunction with any of the detonating means disclosed in FIGS. 2 through 8. In every instance the dust particles will enhance the explosion of the methane-oxygen mixture.

Figure 10:
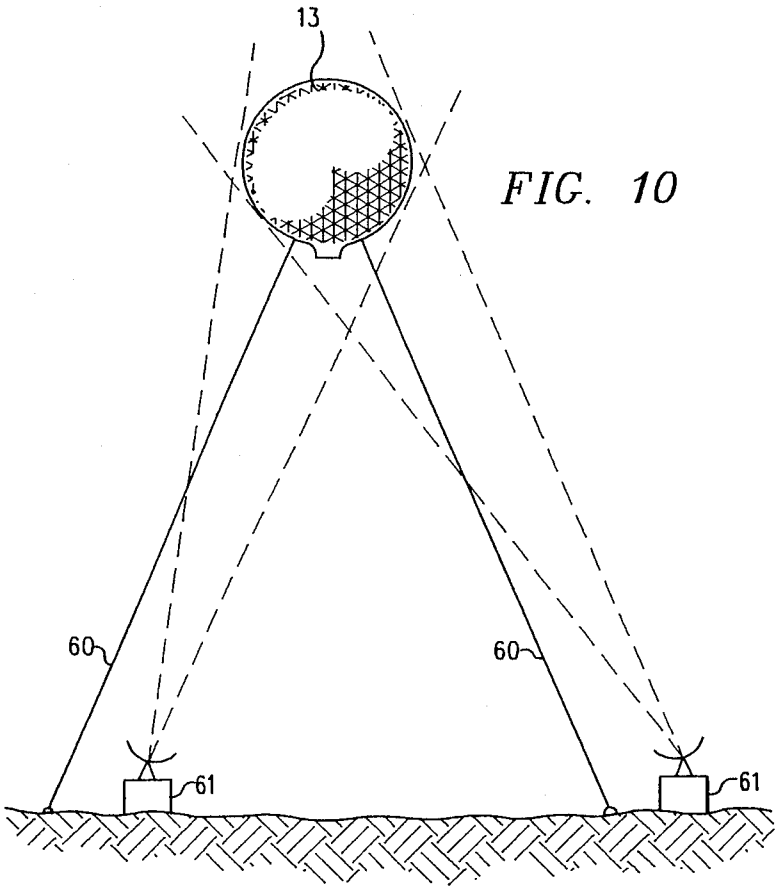
FIG. 10 is an illustration of the envelope of FIG. 1 at a position above the surface.

FIG. 10 discloses a modification of the present invention wherein the explosion is to be carried out above the earth's surface. Envelope 13 is first partially filled with a non-explosive methane-oxygen mixture as described above and then topped-out with the addition oxygen just prior to launch. The gas mixture within envelope 13 provides more than sufficient buoyancy for lifting the filled envelope 13 to an altitude above the earth's surface. Envelope 13 may be tethered in position by one or more tether lines 60 and is detonated by a firing lead within lines 60 or by radar or radio frequency energy transmitted by one or more antennae 61.

While methane is considered to be the preferably combustible gas in the present invention, there may be instances where other gas or combinations of gases may be considered. For example, hydrogen yields substantially less Btus per unit volume than methane when exploded but has a much lower mass per molecule. Since the speed of detonation increases as the mass of the molecules of the combustible gas decreases, the continuity of the detonation front through the explosive mixture should be improved by substituting an amount of hydrogen, e.g. 50% by volume, for a like volume of methane within envelope 13.

Also, while the gas-containing structure has been described as an inflatable, spherical envelope, it could take other shapes and configurations without departing from the present invention. For example, other inflatable or expandible shapes can be used such as dirigible-shaped envelopes, cylindrical envelopes, irregular-shaped envelopes, etc. Further, the structure may be an inflatable envelope in connection with a rigid framework, e.g. geodesic domes; a rigid base structure with only an inflatable covering or roof, e.g. domed staduim-like structures; or fully rigid, expendible structures, e.g. greenhouse-like structures. The primary consideration is to loosely contain the desired volume of explosive gas mixture so that when detonated, an explosion having the desired yield will result.

What is claimed is:

1. A method for producing a violent and destructive explosion having high shock energies comprising:

partially filling an expendible structure with an initial mixture of combustible gas and an oxidizer gas in concentrations rich in said combustible gas so that said initial mixture is incapabale of burning or exploding;

mixing additional oxidizer gas into said initial mixture after said initial mixture is in place and contained within said structure to thereby create an explosive mixture within said structure; and detonating said explosive mixture to produce said explosion and thereby destroying said expendible structure.

2. The method of claim 1 wherein said combustible gas is comprised of methane.

3. The method of claim 1 wherein said combustible gas is comprised of a mixture of methane and hydrogen.

4. The method of claim 2 wherein said oxidizer gas is comprised of oxygen.

5. The method of claim 4 wherein said additional oxidizer gas is mixed with said initial mixture by flowing oxygen gas into said structure after said initial mixture is in place within said structure.

6. The method of claim 4 wherein said step of mixing additional oxidizer gas into said initial mixture comprises:

positioning a container of liquid oxygen within said initial mixture within said structure;

positioning an explosive means within said container; and detonating said explosive means to vaporize and disperse said liquid oxygen into said initial mixture.

7. The method of claim 1 wherein said explosive mixture is detonated by exploding conventional explosives positioned within said structure.

8. The method of claim 1 including:

dispersing dust-like particles into such explosive mixture within said structure; and igniting said dust-like particles to detonate said explosive mixture.

9. The method of claim 8 wherein said dust-like particles are comprised of aluminum.

10. The method of claim 1 wherein said explosive mixture is detonated by exploding bridge wires positioned within said structure.

11. The method of claim 1 including:

positioning a mesh of metallic, wire-like filaments throughout said structure; and igniting said mesh to detonate said explosive mixture.

12. The method of claim 1 wherein said mesh is comprised of zirconium.

13. The method of claim 1 wherein said structure is comprised of an inflatable envelope.

14. The method of claim 13 wherein said envelope is spherical inconfiguration when fully inflated.

15. The method of claim 1 wherein the energy yield of said explosive is equivalent to one kiloton or greater of T.N.T.

* * * * *